United States Patent [19]

Sciamonte

[11] 4,185,756

[45] Jan. 29, 1980

[54] DISPENSING PACKAGE AND METHOD

[75] Inventor: Philip A. Sciamonte, St. Catharines, Canada

[73] Assignee: American Flange & Manufacturing Co., Linden, N.J.

[21] Appl. No.: 855,209

[22] Filed: Nov. 28, 1977

[51] Int. Cl.[2] ..... B67B 7/24

[52] U.S. Cl. ..... 222/83.5; 222/562; 222/267

[58] Field of Search ..... 222/80, 81, 83, 83.5, 222/85, 86, 88, 562, 541; 220/66, 267, 277, 278

[56] References Cited

U.S. PATENT DOCUMENTS

| | | | |
|---|---|---|---|
| 1,772,454 | 8/1930 | Bosworth | 222/83 X |
| 2,027,437 | 1/1936 | Karl | 220/66 |
| 3,066,834 | 12/1962 | Kingsbury | 222/562 X |
| 3,266,658 | 8/1966 | Meissner | 220/277 |
| 3,401,819 | 9/1968 | Salamone | 222/83 X |

FOREIGN PATENT DOCUMENTS

| | | | |
|---|---|---|---|
| 2301442 | 9/1976 | France | 220/278 |

*Primary Examiner*—Joseph J. Rolla

[57] ABSTRACT

A dispensing package such as a grease cartridge is made up of a one piece tubular cartridge body and a puncturing end cap. One end of the cartridge body is open and the other end has an imperforate endwall formed with an annular severing zone which surrounds a central cut out panel. The end cap is formed with an interiorly disposed puncturing structure and is adapted to close off the open end of the filled cartridge body. To ready the cartridge for dispensing as in a grease gun, the end cap is removed from the cartridge open end and reapplied over the cartridge closed end. The end cap is then employed to pierce the severing zone of the cartridge endwall and effect removal of the central cut out panel.

6 Claims, 8 Drawing Figures

DISPENSING PACKAGE AND METHOD

BACKGROUND OF THE INVENTION

Up until quite recently most dispensing cartridges of the type commonly employed as refills for manually operated grease guns were constructed from a paper laminate in tubular form. The cartridge body would then be fitted at either end with a metal cap which could either be completely removed or have a removable portion as required for grease gun dispensing. This prior art construction, although quite economical, has a tendency to leak and become messy under prolonged shipping and storage conditions. This deficiency has prompted the search for a packaging improvement in the grease cartridge field.

One approach recently advanced involves molding such dispensing cartridges from synthetic plastic material. While this change in the packaging material markedly improves on sealability it, at the same time, introduces a substantial material cost factor. This added material cost, unless compensated for in the overall design of the plastic dispensing cartridge, weighs heavily against its commercial acceptance. In this regard, the prior art attempts have failed to offer a cartridge construction capable of manufacture under maximum labor saving conditions but have instead had to rely on costly secondary manufacturing operations which involved the steps of perforating and resealing the closed end of the cartridge subsequent to molding.

SUMMARY OF THE INVENTION

The dispensing package and method of this invention avoids the above mentioned additional cost factors in disclosing a tubular plastic cartridge closed at one end and which is molded as a finished product in a single operation. After the cartridge body is filled, such as with grease, the open cartridge end is closed off with a uniquely designed dual function end cap. The result is a low cost, leak resistant convenience package.

The consumer, in order to ready the cartridge for insertion in a conventional dispensing gun, simply removes the end cap, places it over the cartridge closed end and with a sharp axial thrust, punctures the cartridge endwall. A further twist of the cap completely perforates the cartridge endwall and permits the cut out center portion to be removed intact with the end cap.

It is accordingly a principle object of the invention to provide a new and improved, low cost, two piece dispenser package which is easily readied for use without the aid of tools or cutting implements.

Another object is to provide an improved grease gun refill cartridge wherein a tubular cartridge body, molded of synthetic plastic, is integrally closed at one end and an end cap closes off the other end of the filled cartridge body, such end cap being secondarily employed to perforate the cartridge body end wall.

A further object is to provide a new packaging method wherein a dual function receptacle element is employed both as a receptacle closure in one operative position and as a receptacle opening device in another operative position.

Other and more detailed objects will in part be obvious and in part pointed out as the description of the invention taken in conjunction with the accompanying drawing proceeds.

Figure 1:
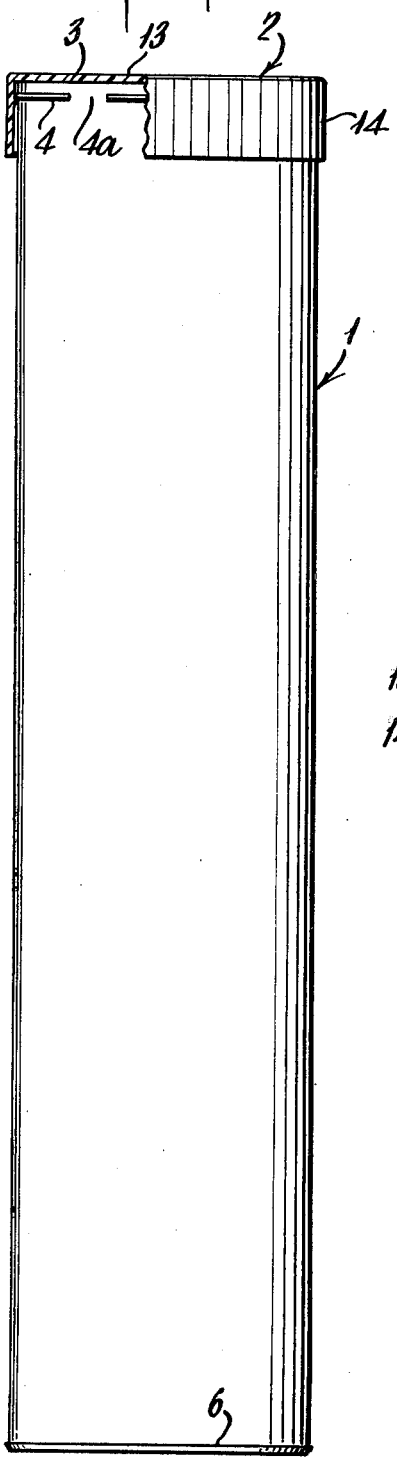
FIG. 1 is an elevational view partly broken away showing the dispensing cartridge of the invention.

The grease cartridge of the invention as seen in FIG. 1 consists of two parts, a cartridge body 1 and an end cap 2. The cartridge body 1 is molded as a hollow, thin walled, tubular member of synthetic plastic by means of the blow molding process and has an open or filling end 3 surrounded by a circumferential locking bead 4 interrupted at 4*a* to provide a vent as further described hereinafter. The other end of the cartridge body 1 is closed with an integrally formed endwall 5 having substantially the same cross sectional thickness as the cartridge sidewall. A circumferential shoulder 6 surrounds the endwall 5 and projects radially outwardly slightly beyond the radial extent of the locking bead 4 at the cartridge open end.

Figure 5:
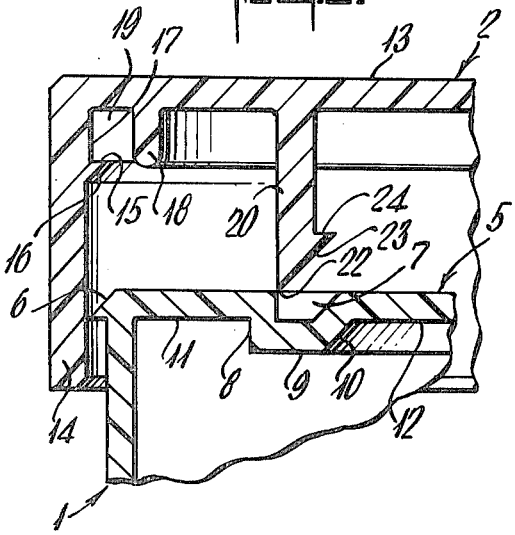
FIG. 5 is an enlarged fragmentary sectional view showing an initial step of the cartridge opening procedure with the cap applied to the closed end of the cartridge body.

In FIG. 5 the cartridge endwall 5 is seen to include an annular severing zone 7 in the form of an upwardly opening groove having a vertical outer wall 8, a bottom wall 9 and an upwardly and radially inwardly inclined inner wall 10. The complete end wall 5 is substantially uniform in cross sectional thickness and is made up in its entirety of an outer annular portion 11, the severing zone 7 and a central cut out panel 12.

Figure 3:
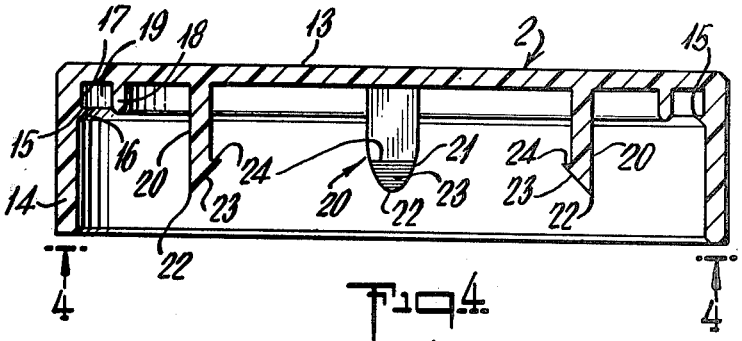
FIG. 3 is a vertical sectional view of the cartridge cap.
Figure 4:
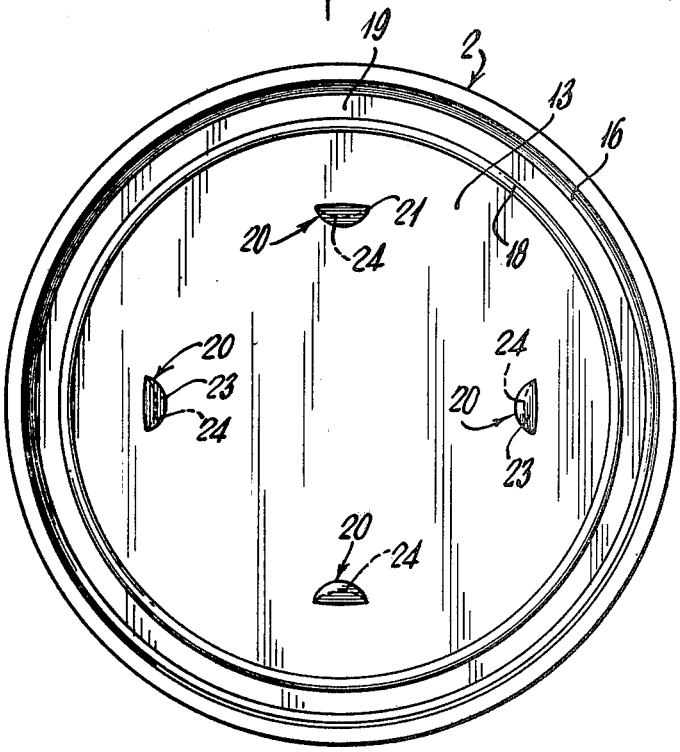
FIG. 4 is a view taken on line 4—4 in FIG. 3 and looking in the direction of the arrows.

As shown in FIG. 3, the grease cartridge end cap 2 is also molded of synthetic plastic and consists of a top wall 13 surrounded by a depending cylindrical sidewall or skirt 14. The interior surface of the skirt 14 is provided with a shoulder 15 having an upwardly and radially inwardly extending conical undersurface 16. An upper sidewall section of reduced internal diameter as indicated at 17 is formed above the shoulder 15.

A short cylindrical collar 18 extends from the interior surface of the cap top 13 creating a narrow downwardly opening groove 19 adjacent the reduced diameter skirt section 17. A series of four puncturing and severing probes 20 also depend from the interior of the cap top 13 and are intermittantly spaced about an annular path disposed radially inwardly of the collar 18 and concentric therewith. Each of the probes 20 is generally formed as a segment of a circle with two side cutting edges 21 extending throughout the probe length. The lowermost distal end of the probe is tapered into a sharp puncturing point 22. The radially inwardly facing lower surface 23 of each probe 20 tapers upwardly at an angle from the point 22 and terminates at a horizontal retaining shelf 24.

Figure 2:
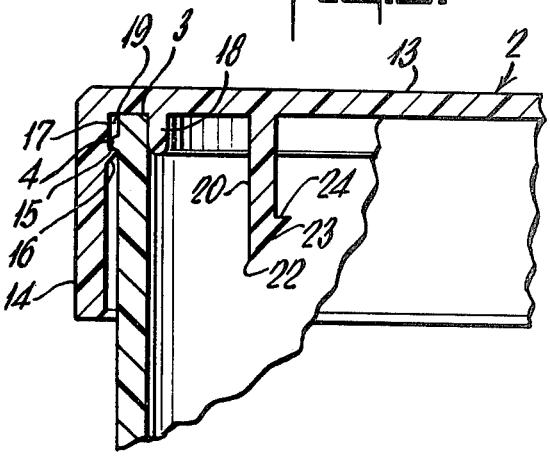
FIG. 2 is an enlarged fragmentary sectional view showing the cap in closing position on the filling end of the cartridge body.

Under actual use conditions the above described two piece dispenser cartridge is employed in the following manner: First the cartridge body 1 is filled through its open end 3 with grease or any other highly viscous material normally suited for pressure gun type dispensing. The cartridge is then closed and sealed with the end cap 2 and, as seen in FIG. 2, the cartridge end 3 extends axially within the cap groove 19 being guided by the conical undersurface 16. In this position the cap 2 is effectively locked against accidental withdrawal by interlocking engagement of the cartridge end locking bead 4 and the shoulder 15 projecting from the interior of the cap skirt. Since the above described cartridge filling is normally carried out at elevated temperatures, the vent gap 4*a* in the locking bead 4 prevents collapsing of the cartridge body upon subsequent cooling of the contents. In addition, the collar 18 prevents collapsing of the cartridge open end and consequent leakage such as might occur from normal handling. The grease cartridge thus effectively closed is then passed through the various channels of distribution to the end user for refilling a conventional grease gun.

Figure 6:
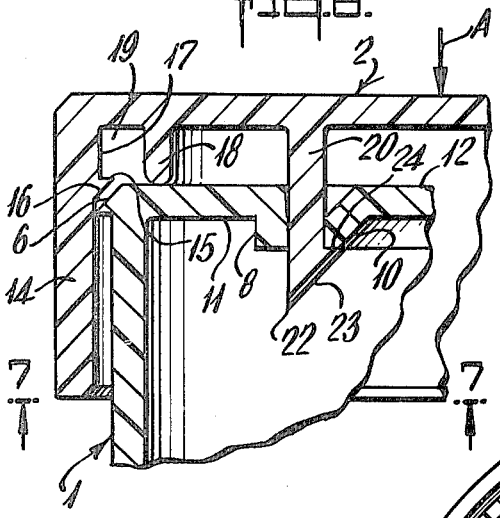
FIG. 6 is a view similar to FIG. 5 showing an advanced step with the cap in a cartridge puncturing position.

To ready the cartridge body 1 for insertion within the barrel of a grease gun, (not shown) the end user first removes the end cap 2 from the cartridge body by axially disengaging the locking bead 4 and the shoulder 15. The end cap 2 is then applied over the closed end of the cartridge body, as seen in FIG. 5, with the shoulder 6 fitting snugly within the interior of the cap skirt 14. As the cap top wall 13 is vertically displaced toward the cartridge endwall 5, the curved radially outwardly facing surface of each probe 20 is concentrically aligned with the inner surface of the vertical wall 8 in the severing zone 7. At this point, the application of a sharp axial thrust in a direction indicated by the arrow "A", drives the probe puncturing points 22 through the severing zone bottom wall 9 as clearly illustrated in FIG. 6. Here it can be seen that the axial travel of the cap 2 relative to the cartridge body 1 is limited by abutting engagement of the collar 18 with the cartridge annular portion 11 leaving the cap top wall 13 slightly axially spaced above the cartridge endwall 5. The resulting penetration of the severing zone 7, however, is such that the probe angled surfaces 23 are caused to ride downwardly past the tearing zone angled inner wall 10. As soon as the angled surfaces 23 penetrate completely through the tearing zone bottom wall 9, the angled inner wall 10 flexes radially outwardly and becomes tightly seated on the retaining shelf 24.

Figure 7:
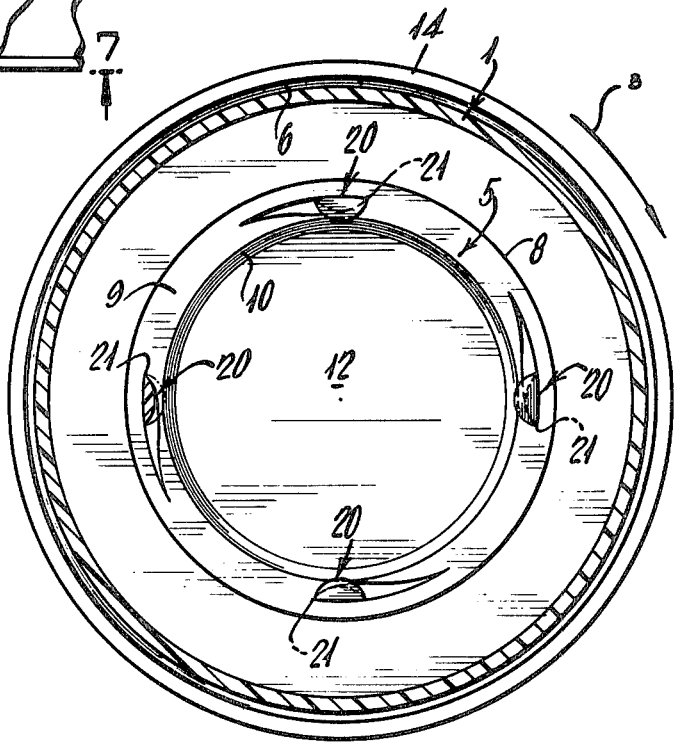
FIG. 7 is a view taken on line 7—7 in FIG. 6 and with the cap rotated slightly showing a further advanced endwall cutting step.

The cap 2 is then simply rotated about the cartridge end, as indicated by the arrow B in FIG. 7, causing the probe cutting edges 21 to slit the severing zone bottom wall 9 along a circular path and with the lower edge of the angled inner wall 10 riding on top of the retaining ledge 24. The provision of dual cutting edges 21 on each probe permits equally effective severing regardless of the direction of rotation of the cap 2. With the use of four probes, a cap rotational displacement of at least 90 degrees completely separates the cartridge center panel 12 from the outer annular portion 11.

Figure 8:
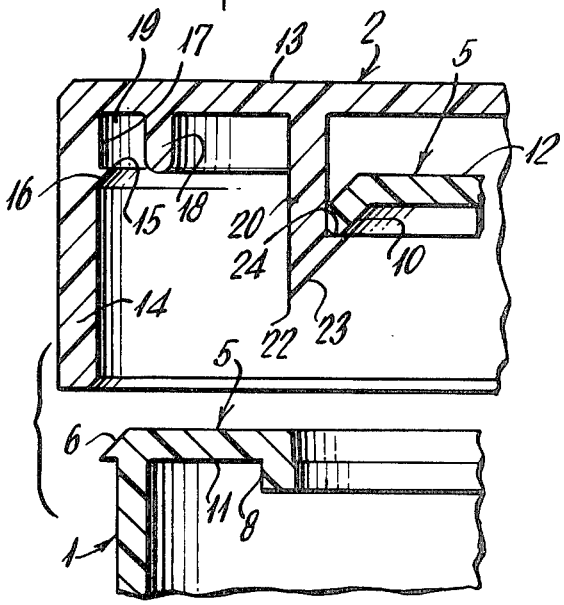
FIG. 8 is an exploded vertical sectional view showing the final cartridge opening step with the cap and severed center panel separated from the cartridge body.

The center panel 12 thus completely severed from the end wall 5, is tightly gripped about the angled wall 10 by the probes 21 and held on the respective retaining ledges 24 against the possibility of falling through the severed opening and into the cartridge body. As seen in FIG. 8, axial separation of the cap from the cartridge body withdraws the probes 21 carrying the cut out center panel from the severed opening. The cap, still tightly retaining the center panel, is then properly discarded leaving the cartridge body effectively readied for insertion within the barrel of a conventional grease gun.

From the foregoing it is apparent that the above described two piece grease cartridge construction takes full advantage of the superior sealing qualities of relatively impervious synthetic plastic material while at the same time offering a substantial cost benefit as a result of reducing the number of manufacturing steps to an absolute minimum. In addition the ready accessibility of the cartridge contents by means of a very simple hand applied push and twist action on the cap introduces a highly desirable factor of convenience.

Changes in or modifications of the construction and different embodiments of the invention would suggest themselves to those skilled in the art and could be made without departing from the spirit or scope of the invention. For example, the above described method steps of opening a sealed container could be advantageously adapted to various packaging applications. Moreover, the structure could be varied in the number and shape of the puncturing probes. It is, accordingly, intended that all matter contained in the above descriptions or shown in the accompanying drawing should be interpreted as being illustrative and not in a limiting sense.

I claim:

1. A dispensing cartridge and closure combination for holding nonflowable substances comprising, a tubular cartridge body molded of synthetic plastic, said tubular body having an open end and a closed end, a severable panel integrally formed in said closed end, a severing zone structurally formed in said closed end surrounding said panel, a closure member fitted to said body open end for sealing off said open end and directly containing said nonflowable substance within said cartridge, said closure member having a disc like center panel surrounded by a cylindrical sidewall, severing means formed on said closure member for cooperative engagement within said severing zone and means formed on said closure member for retaining said severable panel thereon whereby said closure member may be removed from said cartridge body open end and employed to remove said severable panel intact from said cartridge body closed end.

2. A dual function closure cap for use with severable panel receptacles, said cap comprising a disc-like top panel surrounded by a depending cylindrical skirt, radially extending receptacle engaging means formed on the interior surface of said cap skirt to enable use of said cap as a receptacle sealing closure, a series of severing probes depending from said cap top panel and concentrically arranged radially inwardly of said cap skirt disposed within said cap for removing a receptacle panel and radially inwardly extending retaining means formed on each of said probes for holding a removed panel within said cap.

3. A dispensing cartridge for holding nonflowable substances comprising a tubular one-piece body integrally molded of synthetic plastic, said tubular body having an open end and closed end, circumferentially extending closure cap receiving means surrounding said open end, a circumferentially projecting shoulder surrounding said closed end having a maximum diameter greater than the diameter of said cap receiving means, a severable panel integrally formed in said closed end and a severing zone surrounding said panel to facilitate removal of said severable panel intact from said cartridge body closed end.

4. A dispensing cartridge as in claim 3 wherein said severing zone extends along an annular path and has an upwardly opening channel shaped cross sectional configuration.

5. A dispensing cartridge as in claim 3 and said severing zone including panel gripping means.

6. A method of packaging and dispensing viscous substances comprising the steps of filling a tubular dispensing cartridge with a viscous substance, said cartridge having an open end and an imperforate endwall, applying a closure member to said cartridge open end to seal off said open end and directly contain said viscous substance within said cartridge, subsequently readying said cartridge for dispensing by removing said closure member from said open end, axially displacing said closure member to penetrate said endwall, rotatably displacing said closure member relative to said endwall causing a portion of said endwall to be severed along a predetermined path, gripping said severed wall portion along said severed path, and axially displacing said receptacle element away from said endwall causing said severed wall portion to be removed intact with said receptacle element.

* * * * *